US005525170A

United States Patent [19]

Stark et al.

[11] Patent Number: 5,525,170

[45] Date of Patent: Jun. 11, 1996

[54] FUMARIC ACID-BASED GAS GENERATING COMPOSITIONS FOR AIRBAGS

[75] Inventors: Armin Stark, Mühldorf/Inn; Siegfried Zeuner, München; Karl-Heinz Rödig, Aschau', all of Germany

[73] Assignee: TEMIC Bayern-Chemie Airbag GmbH, Aschau, Germany

[21] Appl. No.: 452,292

[22] Filed: May 26, 1995

[30] Foreign Application Priority Data

Jul. 1, 1994 [DE] Germany ..... 44 23 088.5

[51] Int. Cl.[6] ..... C06B 29/04

[52] U.S. Cl. ..... 149/85; 149/77; 149/83

[58] Field of Search ..... 149/7, 83, 19, 149/19.7, 85, 77

[56] References Cited

U.S. PATENT DOCUMENTS

| | | | |
|---|---|---|---|
| 3,839,105 | 10/1974 | Dewitt et al. | 149/19.4 |
| 3,880,595 | 4/1975 | Timmerman | 422/164 |
| 3,910,805 | 10/1975 | Catanzarite | 149/83 |
| 4,152,891 | 5/1979 | Garner | 60/205 |
| 4,246,051 | 1/1981 | Garner et al. | 149/7 |
| 4,948,439 | 8/1990 | Poole et al. | 149/46 |
| 5,125,684 | 6/1992 | Cartwright | 280/736 |

FOREIGN PATENT DOCUMENTS

| | | |
|---|---|---|
| 0543026 | 5/1993 | European Pat. Off. . |
| 1290418 | 9/1972 | United Kingdom . |

OTHER PUBLICATIONS

Merck Index, 11th Ed., pp. 1958 and 4203.

*Primary Examiner*—Donald P. Walsh
*Assistant Examiner*—John B. Hardee
*Attorney, Agent, or Firm*—Spencer & Frank

[57] ABSTRACT

The subject invention concerns a propellant mixture for producing propellant gas for passenger protection systems in motor vehicles, in particular airbag systems. According to this invention, this propellant mixture comprises fumaric acid, with a share of 20 to 45% by weight, as well as an inorganic oxidant with a share of 55 to 80% by weight. These revealed propellant components are non-toxic and characterized by a high thermal stability as well as low hygroscopicity. In addition, this propellant contains only minor traces of pollutant gases, with even combustion residues being non-toxic.

4 Claims, 2 Drawing Sheets

| PROPELLANT MIXTURE | CO [ppm] | $NO_x$ [ppm] | $NH_3$ [ppm] |
|---|---|---|---|
| SUBSTANCE MIXTURE 1 | 15 000 | 500 | 3000 |
| SUBSTANCE MIXTURE 2 | 3 000 | — | — |

FUMARIC ACID-BASED GAS GENERATING COMPOSITIONS FOR AIRBAGS

BACKGROUND OF THE INVENTION

This invention concerns a gas-generating substance mixture, which is useful to produce propellant gas for passenger protection devices in motor vehicles, in particular airbag systems.

Passive safety devices for motor vehicles, such as e.g. airbag systems, serve to protect vehicle passengers from injuries in the event of a vehicle collision occurring. To this end, a gas generator contains a gas-generating substance mixture inside a combustion chamber; this gas-generating substance mixture takes the form of tablets, pellets, or granules, and, on activation, produces a propellant gas which in turn blows up a gas bag; this will, for example, prevent vehicle passengers from hitting windscreen, steering wheel, or dashboard.

Various substance mixtures are known as gas-generating substance mixtures. Thus, for example, sodium azide is used as a gas-supplying principal component; potassium nitrate, as an oxidizing agent, and silicon dioxide, with silicon dioxide chemically binding as slag, the substances sodium and potassium formed as a result of the azide reacting with the nitrate. A major disadvantage of using propellants containing sodium azide is their high toxicity. This requires special measures, for manufacture, transporting, and disposal, among others. A further disadvantage lies in the alkaline reaction of combustion residues, liable to cause a corrosion hazard.

In addition, gas-generating masses are known, which consist of an alkali metal azide and a metal oxide, mostly of iron oxide (cf. DE-OS 24 59 667). However, these known substance mixtures are characterized by a slow combustion speed and poor ignitability. Furthermore, a substance mixture comprising nitrocellulose and nitroglycerin is known from DE-OS 43 17 727. Such propellant mixtures, based on nitrocellulose, are characterized by poor temperature stability; this entails a limited life and makes it impossible to recycle this substance. Moreover, these propellant mixtures contain heavy-metal salts as combustion controllers, which additionally makes disposal difficult. The greatest disadvantage, however, is the enormous quantities of carbon monoxide arising during combustion.

In recent years, sodium-azide-free propellant mixtures have been proposed (U.S. Pat. No. 4,948,439) containing as their principal component organic compounds rich in nitrogen such as tetrazoles or tetrazole derivates or tetrazolates. However, the disadvantage of such nitrogenous organic propellant mixtures is that on combustion considerable quantities of nitrous gases $NO_x$ will be released, in addition to carbon monoxide, so that a combined poisoning hazard cannot be excluded.

Finally, the publication U.S. Pat. No. 3,880,595 reveals substance mixtures based on a nitrogen-free organic compound such as, for example, citric acid. The disadvantage of these propellants is their low thermal stability and their high hygroscopicity as well as their poor processability, in particular, the great difficulties experienced when attempting to compress these substances into tablets or pellets.

SUMMARY OF THE INVENTION

The object of the invention is to provide a gas-generating azide-free propellant mixture consisting of non-toxic components, characterized by a high thermal and chemical stability which is easy to process; is non-hygroscopic, and which features a sufficient combustion speed as well as good ignitability.

According to the invention, this gas-generating substance mixture will consist of an organic compound comprising carbon, hydrogen, and oxygen, with a share of 20 to 45% by weight, as well as an inorganic oxidant from the group of perchlorates, with a share of 55 to 80% by weight, where the organic compound has an oxygen content of more than 35% and a melting point above 170° C.

These propellant components are non-toxic and inexpensive as well as recyclable, and will also be excellent to process. Furthermore, the propellant mixture according to this invention enables a high combustion speed to be achieved, and even with combustion residues being non-toxic. In addition, the propellant gas itself only has a minimum content of pollutant gases. Finally, the propellant mixture according to this invention is free from heavy metals and can be produced at low cost.

A further advantageous application of the substance mixture according to this invention can additionally contain a metal oxide in a maximum quantity of 20% by weight. This metal oxide serves as a cooling agent on the one hand, and on the other, in certain circumstances, as a ballistic additive.

Preferably, monomeric compounds such as carboxylic acids, by choice fumaric acid ($C_4H_4O_4$), anhydrides, esters, aldehydes, keto- and hydroxy compounds, can be used as an organic compound according to this invention. Furthermore, polymers such as polyoxymethylen, polyglycols, polyester, cellulose acetate, and polyacrylate are also suitable as organic compounds. Relevant salts of the monomeric compounds, in particular sodium, potassium, calcium, or magnesium carboxylates can also be used to advantage as organic compounds.

Finally, for the metal oxide, a selection from these groups: $Al_2O_3$, $B_2O_3$, $SiO_2$, $TiO_2$, $MnO_2$, CuO, $Fe_2O_3$, and ZnO can be made, or a mixture thereof may be used.

BRIEF DESCRIPTION OF THE DRAWINGS

In connection with the drawings, the following examples serve to further elucidate this invention.

DESCRIPTION OF THE PREFERRED EMBODIMENTS

According to a first implementation example, the substance mixture will consist of 34.4% (by weight) fumaric acid and 65.6% (by weight) potassium perchlorate. With regard to thermal stability as well as hygroscopicity, this propellant mixture was compared to a substance mixture, known from the above-mentioned publication U.S. Pat. No. 3,880,595, comprising 35.3% (by weight) citric acid and 64.7% (by weight) potassium perchlorate. The results of these comparative experiments are shown in FIGS. 1 and 2.

Figure 1:
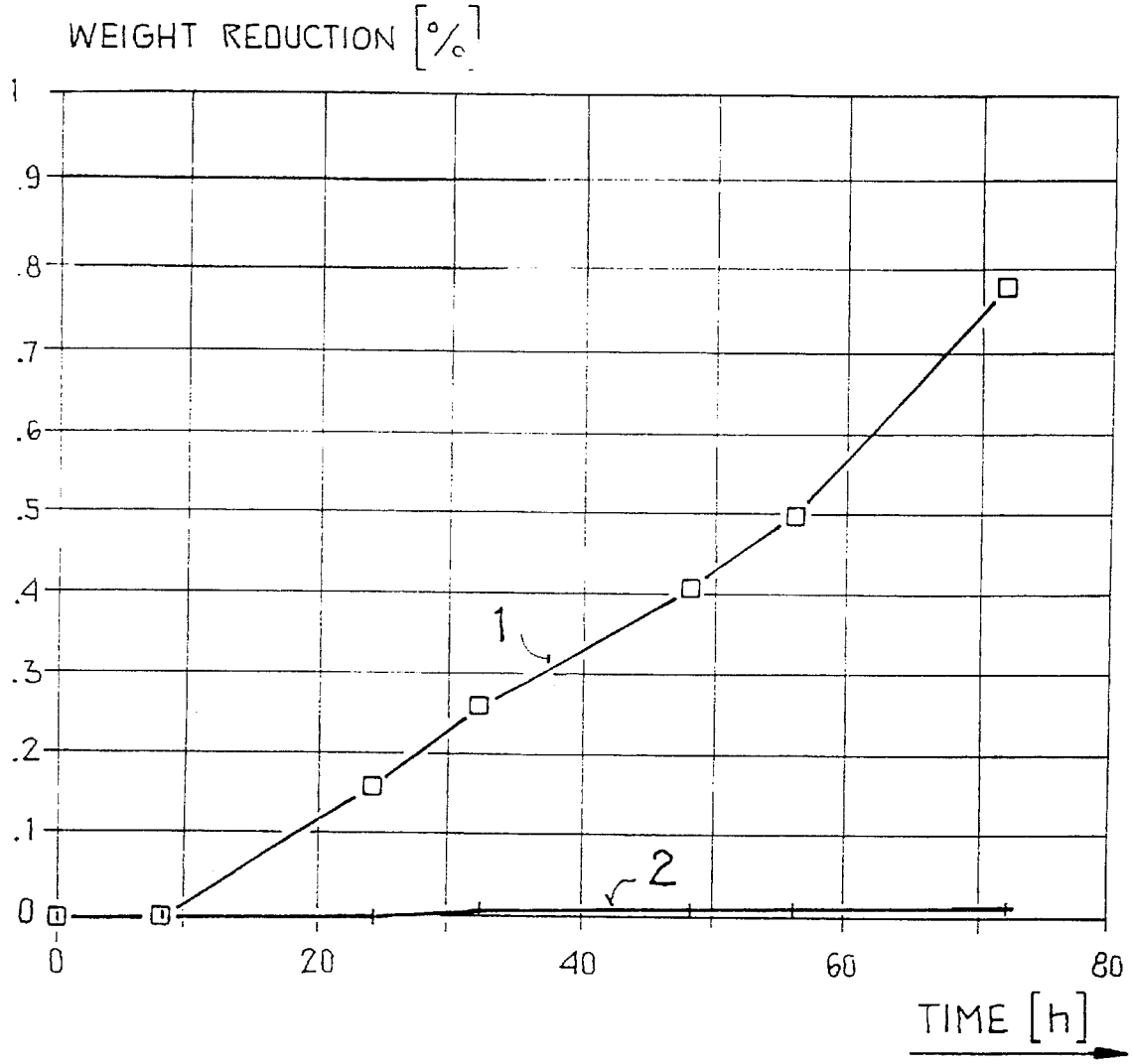
FIG. 1 is a diagram of a stability test for comparing the thermal stability of a substance mixture according to this invention with a known propellant mixture.
Figures 2, 3:
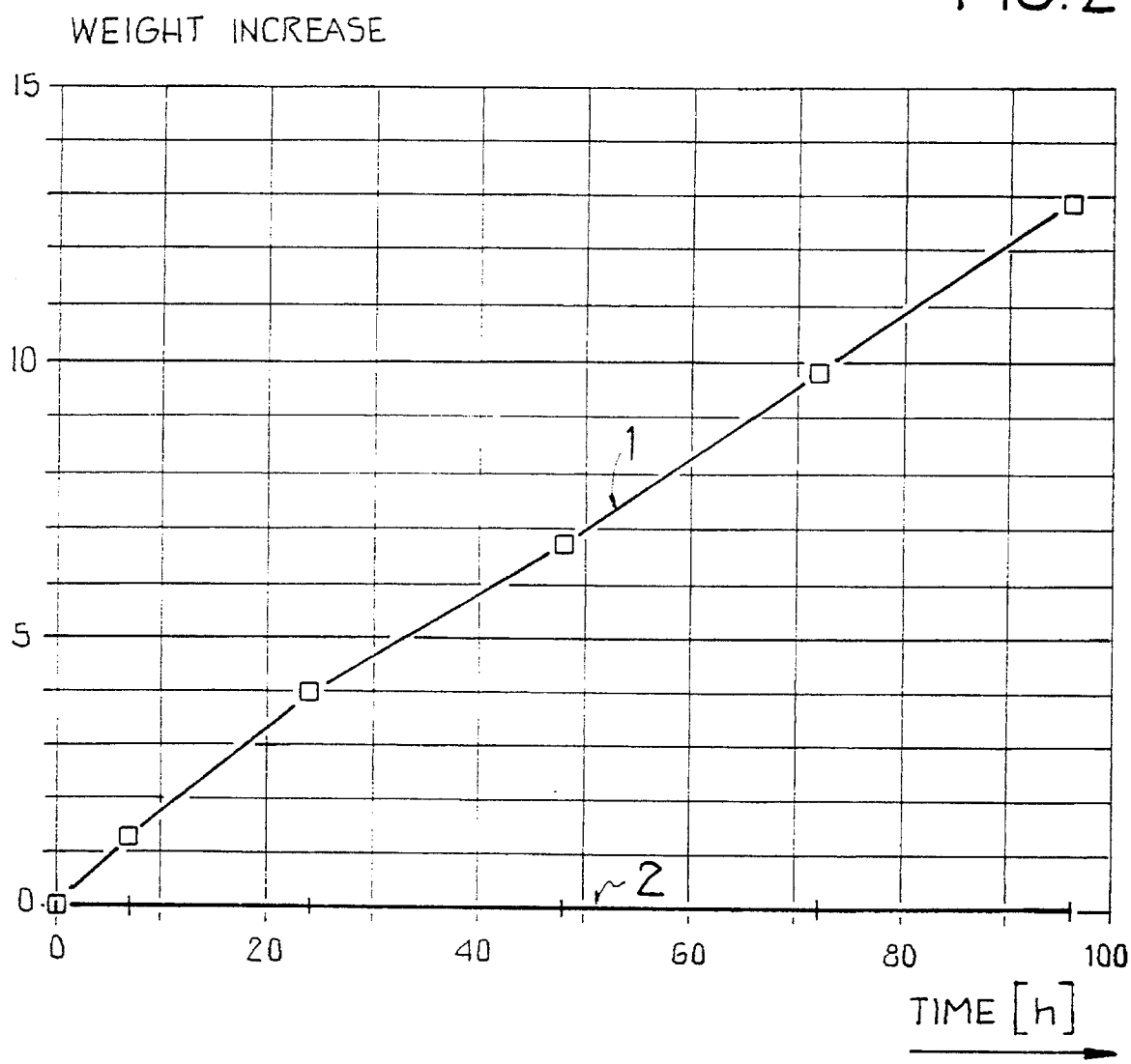
FIG. 2 is a diagram of a hygroscopicity test for comparing a substance mixture according to this invention with the known propellant mixture from FIG. 1.
FIG. 3 is a table listing the pollutant gas contents of a substance mixture according to this invention, as well as of a further known propellant mixture.

According to FIG. 1, the stability test (Holland test) was carried out at a temperature of 110° C. for a period of more than 70 hours. Here, the known substance mixture (item 1) showed a weight reduction of almost 0.8% whereas the substance mixture according to this invention (item 2) showed a weight reduction of less than 0.01%.

The hygroscopicity test was carried out at relative humidity of 86% for a period of almost 100 hours. According to FIG. 2, the known substance mixture (item 1) shows a weight increase of 13% whereas the substance mixture according to this invention (item 2) shows no measurable weight increase.

Finally, the same propellant mixture according to this invention (substance mixture 2) was compared to a further known propellant mixture (substance mixture 1) consisting of 30.8% (by weight) 5-amino-tetrazole, 36.1% (by weight) sodium nitrate, and 33.1% (by weight) iron-(III)-oxide (cf. U.S. Pat. No. 4,948,439). For the purposes of this comparison, the propellants were burnt inside a standard gas generator. To this end, propellant components were finely ground and compressed into tablets. The quantity of gas generated and the gas pressure created proved to be sufficient for filling a 65 liter bag. Measured pollutant gas concentrations here refer to a measurement volume of 60 l. The results of this test are shown in FIG. 3. According to these tests, the known substance mixture 1 will generate 15,000 ppm carbon monoxide (CO), 500 ppm nitrogen oxide ($NO_x$), as well as 3.000 ppm ammonia ($NH_3$), whereas substance mixture 2 according to this invention will only generate 3,000 ppm carbon monoxide but no nitrogen oxide and no ammonia.

A propellant mixture according to this invention, as a second implementation example, will contain 30.2% (by weight) fumaric acid, 63.6% (by weight) potassium perchlorate, and 6.2% (by weight) iron oxide. This iron oxide serves here as cooling reagent and will reduce combustion temperature by approximately 7%. Following combustion, this propellant mixture, too, as specified by the invention, will only generate a pollutant gas content of approximately 3,000 ppm carbon monoxide.

What is claimed is:

1. A gas-generating mixture for producing propellant gas for protection devices wherein the mixture consists essentially of:

a) 20 to 45% by weight of fumaric acid; and b) 55 to 80% by weight of an inorganic oxidant selected from the group consisting of perchlorates, chlorates, peroxides and mixtures of these.

2. The gas-generating mixture according to claim 1 further including no more than 20% by weight of a metal oxide selected from the group consisting of $Al_2O_3$, $B_2O_3$, $SiO_2$, $TiO_2$, $MnO_2$, CuO, $Fe_2O_3$, ZnO, and mixtures of these.

3. The gas-generating mixture according to claim 1 wherein the inorganic oxidant is potassium perchlorate.

4. The gas-generating mixture according to claim 2 wherein the inorganic oxidant is potassium perchlorate and the metal oxide is iron oxide.

* * * * *